US005329502A

United States Patent [19]

Haring et al.

[11] Patent Number: 5,329,502

[45] Date of Patent: Jul. 12, 1994

[54] LIGHT BENDING WATCH APPARATUS

[76] Inventors: Chad T. Haring, 1143 Appleseed La., Apt. A, St. Louis, Mo. 63132; Michael A. Fuller, 12381 Log Post Ct., Apt. A, St. Louis, Mo. 63141

[21] Appl. No.: 165,724

[22] Filed: Dec. 10, 1993

[51] Int. Cl.[5] ..... G04B 37/00

[52] U.S. Cl. ..... 368/276; 368/282; 368/309

[58] Field of Search ..... 368/10, 88, 276, 280–282, 368/309

[56] References Cited

U.S. PATENT DOCUMENTS

| | | | |
|---|---|---|---|
| 2,852,908 | 9/1958 | Stern et al. . | |
| 3,609,960 | 10/1971 | Huther . | |
| 3,633,355 | 1/1962 | Sakata . | |
| 3,768,887 | 10/1973 | Portmann . | |
| 4,118,924 | 10/1978 | Foellner . | |
| 4,327,429 | 4/1982 | Klimoenberg | 364/294 |
| 4,473,304 | 9/1984 | Ketner | 368/281 |
| 4,528,197 | 2/1986 | Lam | 368/235 |
| 4,884,257 | 11/1989 | Swarovski . | |
| 5,065,375 | 11/1991 | Gogniby | 368/281 |
| 5,081,852 | 1/1992 | Cox . | |

*Primary Examiner*—Vit W. Miska

*Attorney, Agent, or Firm*—Harness, Dickey & Pierce

[57] ABSTRACT

A tanning-enabled wristwatch having a watch head assembly and a watch band for suspending the watch head assembly around the wrist of a user. The watch head assembly includes a watch compartment having a time keeping mechanism and a display or other indicator device for conveying a time value to a user. The watch head assembly also feature a unique housing for supporting said watch compartment such that the housing extends below said watch compartment in a predetermined relationship. The housing is made from a material which is capable of transmitting ultraviolet light through the housing. The housing is also formed with a surface configuration for redirecting ultraviolet light impinging upon a top surface of the housing to an area beneath the watch compartment.

9 Claims, 2 Drawing Sheets

LIGHT BENDING WATCH APPARATUS

BACKGROUND OF THE INVENTION

The present invention generally relates to time pieces worn by individuals, and particularly to a watch apparatus which is capable of redirecting ultraviolet light to avoid the obstruction of "tanning" rays from the Sun.

Transmitting tanning rays from the surface of the watch to the skin beneath the opaque components of the watch is a difficult problem to address. For example, a watch could be designed completely of translucent parts which would allow light to pass straight through to the skin. However, this poses significant financial and logistical barriers when considering the complexity of the internal components. Producing transparent time measurement components would not only be very expensive, but would also require a revamping of existing manufacturing facilities. Another possibility would be the use of carefully positioned mirrors to reflect ultraviolet rays around the watch components. This method avoids the component manufacturing problem, but it poses two substantial barriers of its own. First, the smaller the wavelength of electromagnetic radiation becomes, the more difficult it is to reflect. Ultraviolet light is made of very short wave lengths that are significantly shorter than visible light wavelengths. The cost of producing mirrors of a quality that would reflect the percentages of ultraviolet light necessary to achieve even tanning would be high. Second, accurate alignment of the mirrors would be crucial in order to avoid creating "hot spots" as well as to evenly tan the skin. Such an accurate alignment of mirrors would require a more complex manufacturing process than is necessary to obtain the desired results.

Accordingly, it is a principal objective of the present invention to provide a personal timepiece which will enable tanning rays from the Sun to reach the user's skin when the time piece is worn, at a low cost and an attractive design.

It is another objective of the present invention to provide a wristwatch that is constructed such that the opaque components do not obstruct the ultraviolet rays from the Sun which are necessary to enable the skin beneath the wristwatch to tan.

It is an additional objective of the present invention to provide a tanning-enabled wristwatch which may be constructed in a variety of shapes and sizes.

SUMMARY OF THE INVENTION

To achieve the foregoing objectives, the present invention provides a wristwatch which generally includes a watch head assembly and a watch band for suspending the watch head assembly around the wrist of a user. The watch head assembly includes a watch compartment having a time keeping mechanism and a display or other indicator device for conveying a time value to a user. The watch head assembly also features a unique housing for supporting said watch compartment such that the housing extends below said watch compartment in a predetermined relationship. The housing is made from a material which is capable of transmitting ultraviolet light through the housing. The housing is also formed with a surface configuration for redirecting ultraviolet light impinging upon a top surface of the housing to an area beneath the watch compartment.

Additional features and advantages of the present invention will become more fully apparent from a reading of the detailed description of the preferred embodiment and the accompanying drawings in which:

DETAILED DESCRIPTION OF THE PREFERRED EMBODIMENTS

Figure 1:
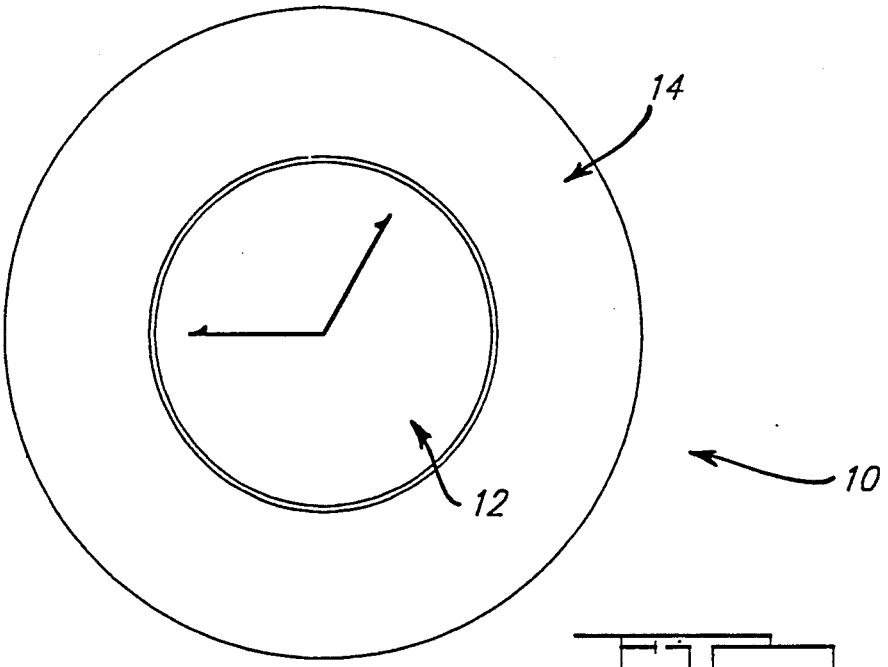
FIG. 1 is a top elevation view of a wristwatch head assembly according to the present invention.

Referring to FIG. 1, a wristwatch head assembly 10 according to the present invention is shown. The wristwatch head assembly 10 includes an opaque watch compartment 12 which is centrally located in transparent housing 14. While the watch compartment 12 itself could also be made with transparent components, such a provision is entirely unnecessary according to the present invention.

Figure 2:
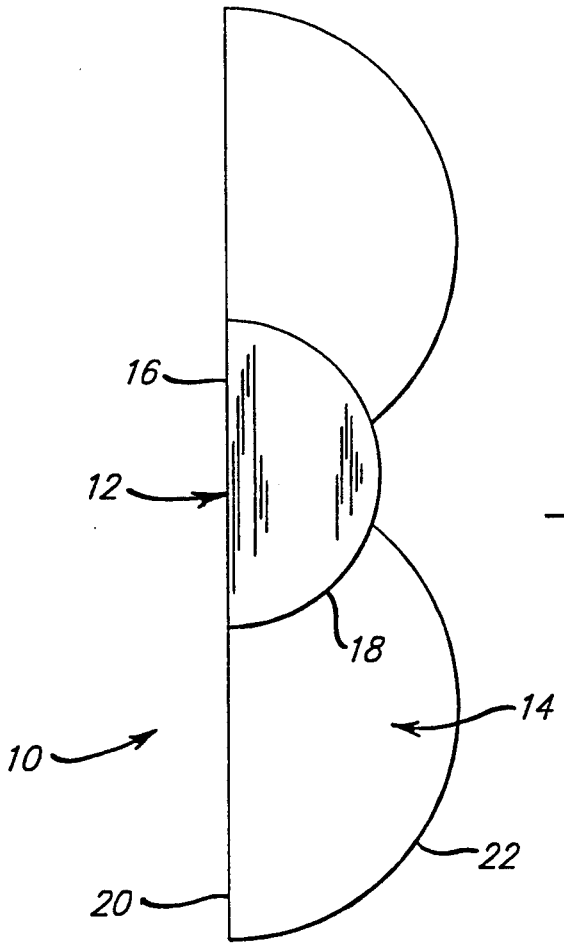
FIG. 2 is a side elevation view of the wristwatch head assembly shown in FIG. 2.

Referring to FIG. 2, the watch compartment 12 is shown to have a semi-spherical shape with a generally planar top surface 16 and a spherical bottom surface 18. In this particular embodiment, the transparent housing 14 also includes a planar top surface 20 which is co-planar with top surface 16 of the watch compartment 12. The transparent housing 14 is further shown to have an annular shape with a semi-tubular bottom surface 22. However, it should be appreciated that both the watch compartment and the transparent housing may be constructed in a variety of shapes and sizes. In other words, the top surfaces 16 and 18 do not need to be planar, and a less rounded appearance could be provided as well. Nevertheless, in accordance with the present invention, a predetermined relationship between the watch compartment 12 and the transparent housing 14 is provided in order to enable the user's skin beneath the watch compartment to tan in an even and effective manner. More specifically, the lower or bottom surface of the watch compartment 12 should be elevated above the user's skin by the transparent housing 14 to an extent that the transparent housing 14 will be capable of redirecting ultraviolet light from the Sun to the area of the user's skin which is below the watch compartment. In other words, ultraviolet light is effectively bent around the opaque components and dispersed in a non-uniform intensity from multi-origin angles across the skin.

In one form of the present invention, the transparent housing 14 is preferably made of CR-39, which is a liquid monomer that has been used for optic quality lenses. The transparent housing 14 may be created by injecting CR-39 into a suitable mold and allowing it sufficient time to harden in the desired shape. However, it should be understood that other appropriate materials may be used to construct the transparent housing, such as a hi index polycarbonate (other optic quality plastics) or glass. CR-39 type plastics will allow a very high percentage of UV rays to pass through the transparent housing 14. Other translucent materials such as glass, crystal and other plastics will allow UV rays to pass in different degrees of attenuation.

It may also be considered advantageous in some circumstances to use materials which will allow UV passage in lesser degrees than CR-39. Accordingly, it may be desirable to select a material which will provide a predetermine degree of UV attenuation, and thereby create a SPF (sun protection factor) type watch case and band for relatively fair skinned persons.

Figure 3:
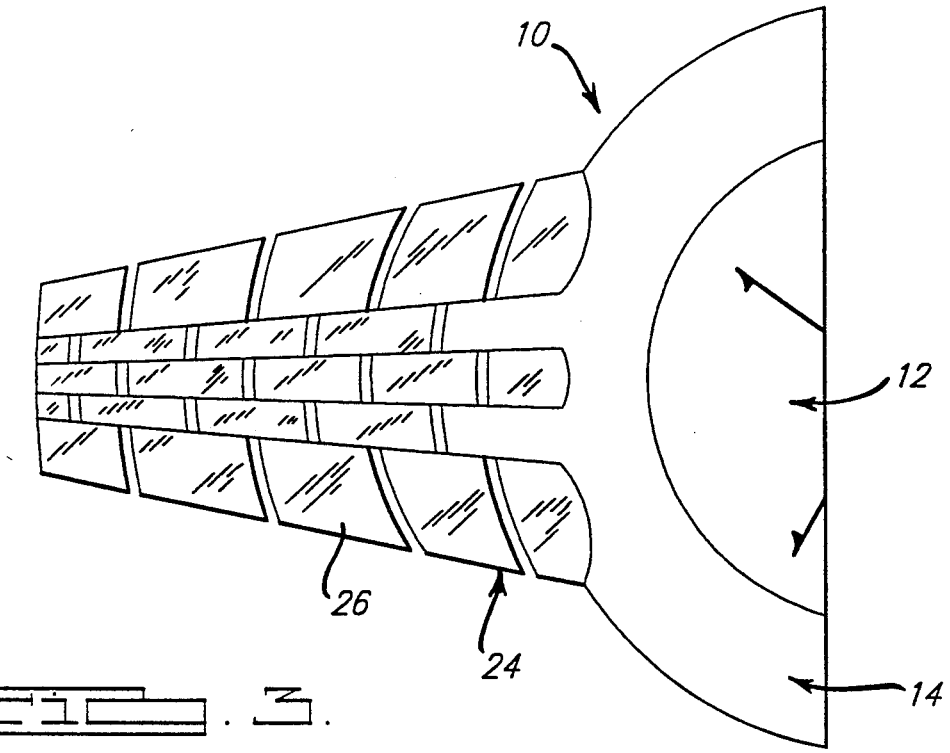
FIG. 3 is a partial top elevation view of a wristwatch apparatus which incorporates the wristwatch head assembly shown in FIG. 1.

Referring to FIG. 3, the transparent housing 14 is shown to be connected to a watch band 24. The watch band 24 is also preferably made of transparent or translucent materials that will transmit UV light. In one form of the present invention, the watch band 24 is comprised of a set of interconnected links 26 to provide flexibility. The links 26 may be connected together by traditional techniques, such as screws, or spring loaded bars, or push pins, provided that they are encased such that UV rays can reach the skin beneath by either channeling UV rays around the opaque connections, or using translucent connectors thereby enabling direct passage of UV rays to skin. Alternatively, the watch band 24 could be entirely comprised of two unitary plastic bands which are sufficiently transparent or translucent to pass the desired amount of UV light to the skin beneath.

Figure 4:
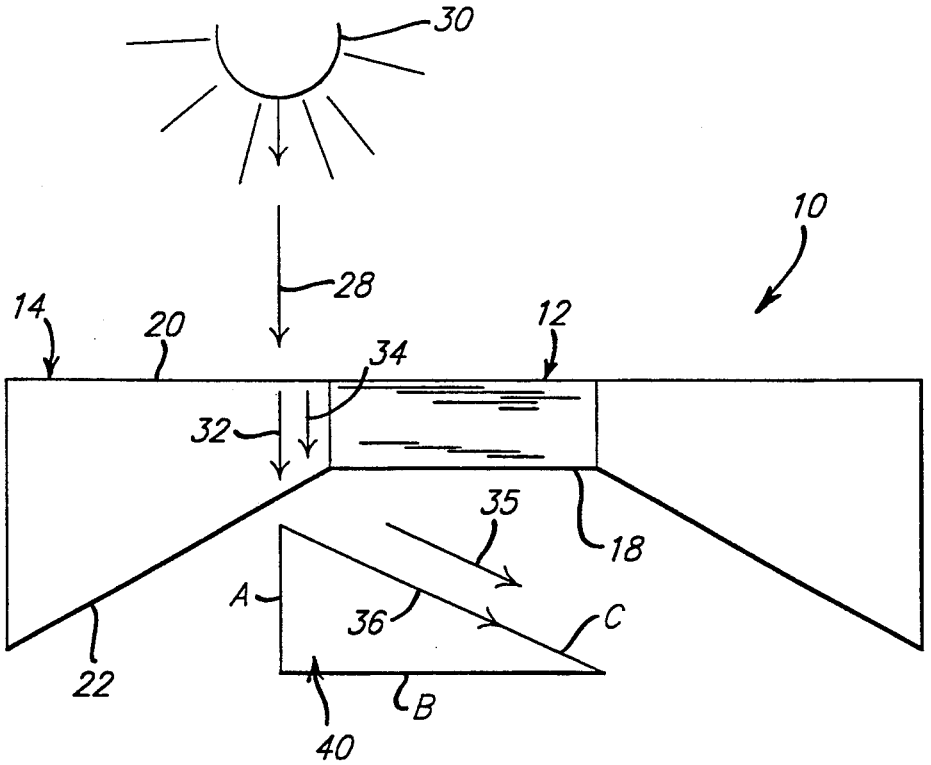
FIG. 4 is a side view of the watch apparatus which illustrates a mathematically-based relationship between the opaque component housing and the surface of the skin which is dependent upon the shape and thickness of the translucent tube housing.

Referring to FIG. 4, a diagrammatic side-elevation view of the watch head assembly 10 is shown. Specifically, FIG. 4 shows a UV ray 28 which impinges the top surface 20 of the transparent housing 14 from the Sun 30. The UV ray 28 is transmitted through the transparent housing 14 as illustrated by ray lines 32 and 34. A substantial amount of light is passed through the bottom surface 22 to the skin beneath, as represented by ray lines 36 and 38. In this regard, it should be appreciated that the UV light received from the Sun will be passing through the transparent housing 14 across the bottom surface 22 of the transparent housing. Preferably, the height of the bottom surface 18 of the watch compartment 12 should be sufficiently elevated that the light passing through one side of the transparent housing 14 will completely cover the skin beneath the watch compartment as shown in FIG. 4. Similarly, the width of the watch compartment 12 will also affect this height value. In other words, if the watch compartment 12 has a relatively small diameter or width, then the bottom surface 18 of the watch may be positioned closer to the skin. This relationship of light to width is illustrated by the triangle 40 shown in FIG. 4. With side "C" of triangle 40 comprising ray line 36 and representing the hypotenuse, then it should be appreciated that the height side "A" and width side "B" may be related through the equation:

$$C = \sqrt{A^2 + B^2}$$

While the bottom surface 22 of the transparent housing 14 is shown to be planar, it is not necessary for a prismatic shape to be provided. However, it should be understood that the transparent housing 14 may be constructed with a prismatic shape as well. Similarly, the links 26 of the watch band 24 may also be formed in a prism shape.

The present invention has been described in an illustrative manner. In this regard, it is evident that those skilled in the art once given the benefit of the foregoing disclosure, may now make modifications to the specific embodiments described herein without departing from the spirit of the present invention. Such modifications are to be considered within the scope of the present invention which is limited solely by the scope and spirit of the appended claims.

What is claimed is:

1. A personal time piece head assembly, comprising:

a watch compartment having a time keeping mechanism and indicator means for conveying a time value to a user; and housing means for supporting said watch compartment such that said housing means extends below said watch compartment in a predetermined relationship, said housing means being made from a material which is capable of transmitting ultraviolet light through said housing means, said housing means also being formed with surface means for redirecting ultraviolet light impinging upon a top surface of said housing means to an area beneath said watch compartment.

2. The invention according to claim 1, wherein said housing means is circumferentially disposed around said watch compartment.

3. The invention according to claim 2, wherein said surface means creates an annular bottom shape for said housing means.

4. The invention according to claim 1, wherein said housing means is constructed from a plastic material.

5. A wristwatch, comprising:

a watch compartment having a time keeping mechanism and indicator means for conveying a time value to a user;

housing means for supporting said watch compartment such that said housing means extends below said watch compartment in a predetermined relationship, said housing means being made from a material which is capable of transmitting ultraviolet light through said housing means, said housing means also being formed with surface means for redirecting ultraviolet light impinging upon a top surface of said housing means to an area beneath said watch compartment; and band means for suspending said housing means on the wrist of the user.

6. The invention according to claim 5, wherein said band means is constructed of a generally transparent material.

7. The invention according to claim 6, wherein said band means includes a set of interlocking prismatic members.

8. The invention according to claim 5, wherein said housing means is made from a plastic material.

9. The invention according to claim 8, wherein said housing means is made from CR-39 plastic.

* * * * *